US007694755B2

(12) United States Patent
Marvel et al.

(10) Patent No.: US 7,694,755 B2
(45) Date of Patent: Apr. 13, 2010

(54) SYSTEM, METHOD, AND APPARATUS FOR VARIABLE JUNK SLOT DEPTH IN DRILL BIT BODY TO ALLEVIATE BALLING

(75) Inventors: Timothy King Marvel, The Woodlands, TX (US); William Henry Sherwood, Jr., Spring, TX (US); David A. Trivas, Houston, TX (US); Michael R. Wells, Lakewood, CO (US)

(73) Assignee: Baker Hughes Incorporated, Houston, TX (US)

( * ) Notice: Subject to any disclaimer, the term of this patent is extended or adjusted under 35 U.S.C. 154(b) by 192 days.

(21) Appl. No.: 11/872,069

(22) Filed: Oct. 15, 2007

(65) Prior Publication Data

US 2009/0095537 A1 Apr. 16, 2009

(51) Int. Cl.
*E21B 10/43* (2006.01)

(52) U.S. Cl. ..... 175/398

(58) Field of Classification Search ..... 175/398, 175/391, 400; 76/108.1, 108.2, 108.4
See application file for complete search history.

(56) References Cited

U.S. PATENT DOCUMENTS

| | | | | | |
|---|---|---|---|---|---|
| 3,153,458 | A | * | 10/1964 | Short | 175/393 |
| 3,191,698 | A | * | 6/1965 | Short | 175/400 |
| 4,883,132 | A | | 11/1989 | Tibbitts | |
| 5,605,198 | A | * | 2/1997 | Tibbitts et al. | 175/432 |
| 5,671,818 | A | * | 9/1997 | Newton et al. | 175/393 |
| 6,021,858 | A | * | 2/2000 | Southland | 175/431 |
| 2006/0016624 | A1 | | 1/2006 | Tibbitts | |

FOREIGN PATENT DOCUMENTS

| | | |
|---|---|---|
| EP | 0171915 | 2/1986 |
| EP | 0874127 A2 | 10/1998 |
| WO | WO99/13194 | 3/1999 |

* cited by examiner

*Primary Examiner*—Kenneth Thompson

(57) ABSTRACT

An earth boring drill bit design for alleviating balling varies the junk slot depth in junk slots subject to balling from the other junk slots. Using variable depth bit bodies enhances the hydraulic characteristics of the bit as well as assists in the placement of the nozzles for machining purposes. This flexibility optimizes the area changes along the ducts required by the bit's operation.

17 Claims, 5 Drawing Sheets

SYSTEM, METHOD, AND APPARATUS FOR VARIABLE JUNK SLOT DEPTH IN DRILL BIT BODY TO ALLEVIATE BALLING

BACKGROUND OF THE INVENTION

1. Technical Field

The present invention relates in general to drill bit junk slots and, in particular, to an improved system, method, and apparatus for alleviating balling with variable junk slot depths in PDC drill bits.

2. Description of the Related Art

Polycrystalline diamond compact (PDC) drill bits have a common bit body and a plurality of fixed blades. Each pair of adjacent blades is separated by an elongated gap that is commonly referred to as a junk slot. Traditionally, PDC bits use the same junk slot depth for all junk slots. This design practice was acceptable when drill bits were created on a drafting table or with a two-dimensional computer aided (CAD) design system. However, with current three-dimensional CAD and computer aided manufacturing (CAM) systems, and numerically controlled machine tools the design of the bit body can be very flexible.

Drill bit "balling" occurs when the cuttings generated by a drill bit clog the junk slots such that removal of additional formation is impeded. Balling adversely affects the overall performance of drill bits and is generally recognized to be responsible for a significant reduction in the rate of penetration (ROP) of drill bits. Three factors that contribute to balling include: hydraulics (e.g., flow patterns, mud properties, etc.), operations (e.g., weight on bit, bit rotational speed, formation, etc.), and mechanical factors (e.g., a bit's physical design, cutter selection, etc.). Eliminating or controlling these factors directly affects the balling characteristics of any specific PDC bit.

Historically, the analysis of PDC drill bits with regard to balling has been focused on the operational parameters drilling mud rheology, flow rate and HSI. Although these two parameters have been shown to affect maximum penetration rates, other controllable variables have been identified that also contribute to bit balling. In addition, current models developed to predict ROP based on flow rate and/or HSI are not accurate, and no known model can establish the theoretical ROP limit for a given PDC drill bit. Thus, an improved drill bit design for reducing or eliminating balling would be desirable.

SUMMARY OF THE INVENTION

Embodiments of a system, method, and apparatus for alleviating balling in PDC drill bits varies the junk slot depth for at least one of the junk slots from the other junk slots. The onset of balling often starts at the pinch points on the primary junk slots of PDC bits. With the use of pinch point analysis, it was determined that an area across the pinch point in conjunction with the cuttings generated by the cutters preceding this area was the cause of balling. Accordingly, the junk slot depth and/or width are altered to change the cross-sectional area at the pinch point. The invention is particularly useful given that the cuttings generated typically may not be changed without slowing down the rate of penetration of the bit, and that the blade width and location also are design limited. The invention also allows the designer to maintain the blade strength of a particular blade by only adjusting the depth of one of the two junk slots surrounding the blade while leaving the other junk slot depth at the original depth.

Using variable depth bit bodies enhances the hydraulic characteristics of the bit as well as assists in the placement of the nozzles for machining purposes. For example, the distance from the bit contour to the bit body is larger when the spacing between the blades is small, and is smaller when the spacing between the blades is larger. Such flexibility allows bit designers to optimize the area changes along the ducts required by the bit's operation. The depth between the blades may be blended to minimize or eliminate hydraulic dead spots. The areas between the nozzle counter bores and the bit bodies also may be blended for the same reason.

In one embodiment, a method of the invention may be practiced by creating solids representing ducts and subtracting them from the overall bit solid that is defined in the initial phase of design. The remaining material on the bit solid forms the blades. Each duct may be individually designed to optimize its shape for the adjacent cutters and the nozzles that supply the drilling fluid. In contrast, the old method used a single curve to represent the "floor" of each junk slot, and adjusting that curve would improve the design of one junk slot while degrading that of others. This invention decouples the design of an individual junk slot and allows for customizing each one to achieve global hydraulics optimization.

Another benefit is the avoidance of a pitfall that occurs using ordinary CAD methods, namely, the creation of models that are very difficult to manufacture. Manufacturability is ensured by the invention by controlling the curves that generate the solids that are subtracted from the bit.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

A given earth boring bit has a theoretical mechanical limit or "static limit." The static limit is based on a ratio of the minimum cross sectional area 11 (see FIG. 1) within a junk slot 13 to the volume of rock that must pass through this area. The static limit only considers the bit shape, or more specifically the junk slot shape, in comparison to the cuttings load. The static limit is established through the use of 3D models, computational fluid dynamics (CFD), simulator tests, and other drill bit design software.

Figure 1:
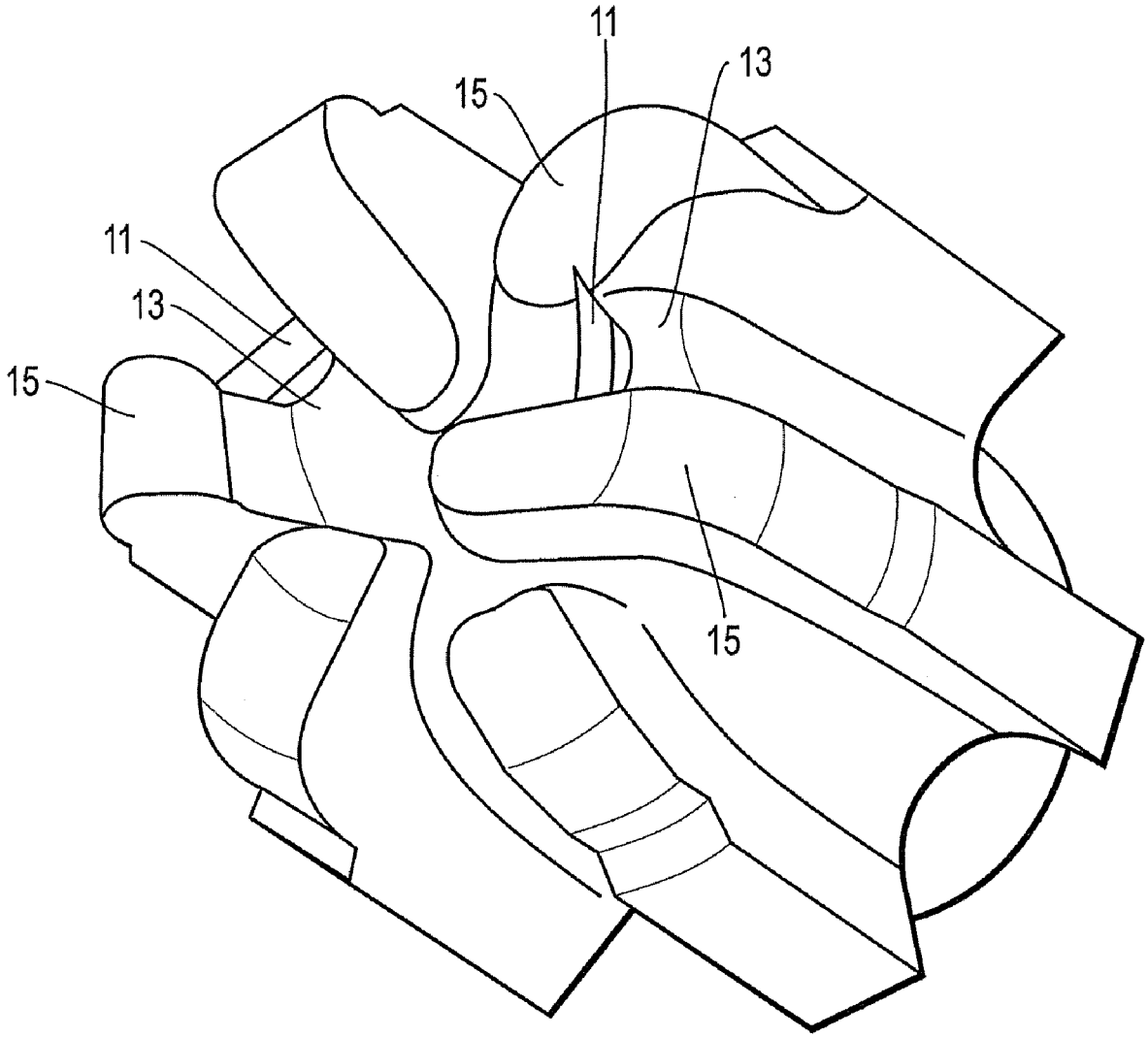
FIG. 1 (Prior Art)
FIG. 1 is a bottom isometric view of a conventional drill bit.
Figure 2:
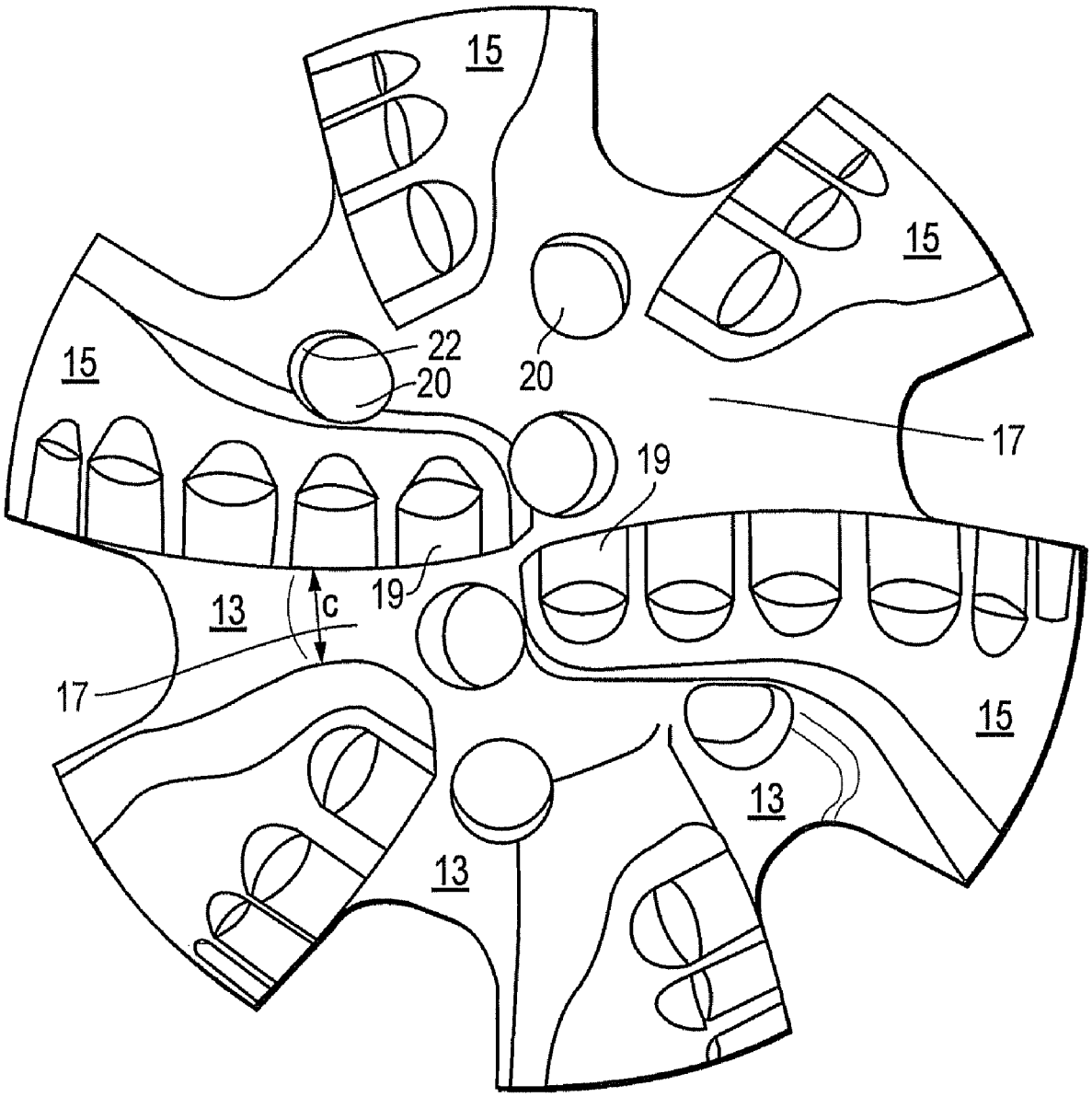
FIG. 2 (Prior Art)
FIG. 2 is a bottom view of the drill bit of FIG. 1.

Comparing FIGS. 1 and 2, the static limit of a bit is established by measuring the smallest cross sectional area 11 between any two blades 15, and then relating that to the volume of cuttings generated above (i.e., toward the bit center) that minimum area to define "pinch points" 17. Typically, the minimum area 11 is located on the face of the bit between a primary and secondary blade 15 near the beginning of the secondary (i.e., upstream) blade. A vertical plane (i.e., along the bit or z-axis) or sheet body is then created that defines the minimum area between the two blades. The sheet body is then intersected with the body and blades of the bit, and the area of this sheet body is calculated. The number of cutters 19 (FIG. 2) radially inward of this minimum area is counted, including any cutters that the area bisects. A theoretical volume of rock removed (VORR) is calculated for each counted cutter using a reference ROP. The total VORR of the cutters radially inward of the minimum area is then divided into this area to establish the area/VORR ratio used in the static ratio or "pinch point ratio."

Figure 3:
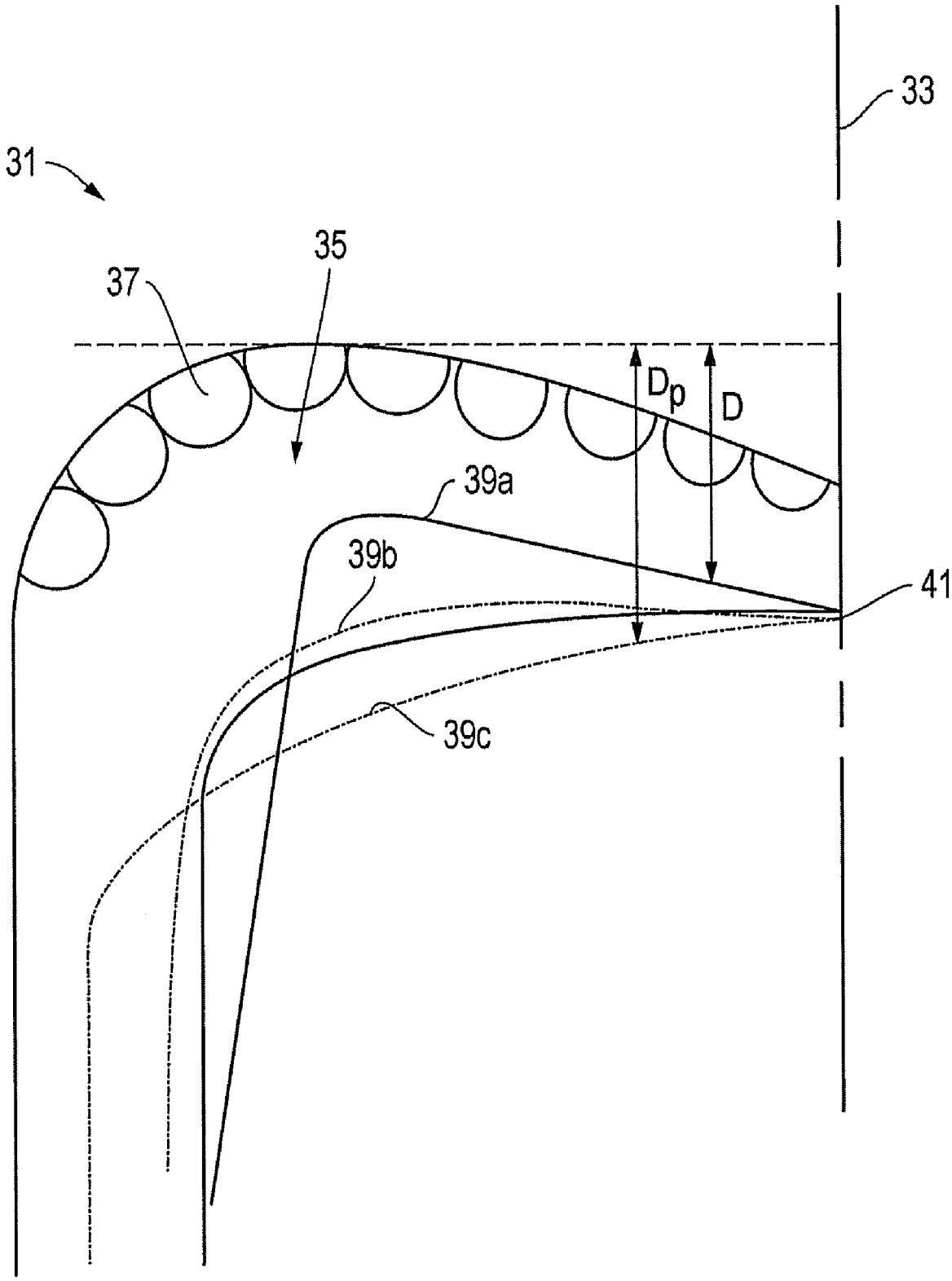
FIG. 3 is a rotational side view of one embodiment of a drill bit comparing multiple junk slots thereof and is constructed in accordance with the invention.

Referring now to FIG. 3, one embodiment of a drill bit for boring earthen formations comprises a bit body 31 having an axis of rotation 33 and a plurality of blades 35 extending therefrom. Each blade 35 has a plurality of cutters 37 affixed thereto. A total of 2 to 13 blades may be used on a drill bit depending on the application, and the bit body may be fabricated with different types of molds including milled molds, sand molds, etc. The bit body can also be fabricated from steel bar stock, or other material.

Junk slots 39*a, b, c* (e.g., only three are shown for ease of illustration) are formed in the bit body 31 and located between adjacent ones of the blades 35 to define a plurality of junk slots. Each of the junk slots 39 has a depth D extending in an axial direction. At least one of the junk slots 39 is defined as a primary junk slot 39*c* having a primary junk slot depth $D_p$ that is greater than the depths D of the other junk slots 39*a, b* for alleviating balling in that particular junk slot.

In one embodiment, the primary junk slot 39*c* comprises a plurality of primary junk slots, each of which is formed at the primary junk slot depth $D_p$. The primary junk slot depth $D_p$ is located at a pinch point (compare FIG. 2) between adjacent ones of the blades 35 and defines a cross-sectional area (compare FIG. 1) that is greater than a cross-sectional area located at the pinch points for other ones of the junk slots 39. In another embodiment, each of the junk slots is formed at a junk slot depth that differs from all other ones of the junk slots.

As shown in FIG. 3, the primary junk slot depth $D_p$ and the depths D of the junk slots 39*a, b* are blended (e.g., at surface 41 in FIGS. 3 and 5) to reduce hydraulic dead spots during operation of the drill bit. In addition, the bit body has hydraulic fluid nozzles (see, e.g., nozzles 20 in FIG. 2) located in counterbores 22. Areas of the bit body located between the counterbores 22 are blended to reduce hydraulic dead spots during operation of the drill bit.

Figure 4:
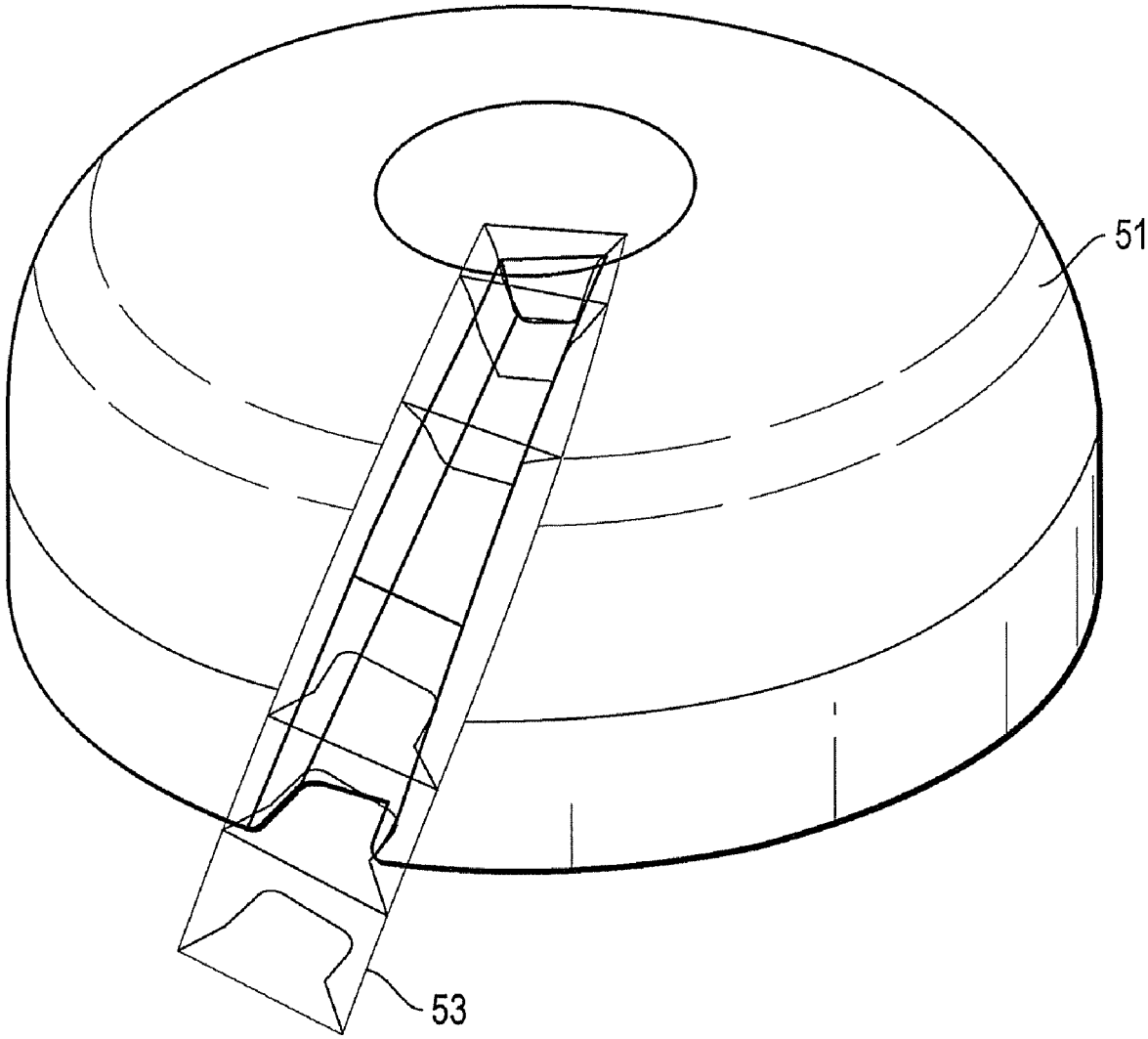
FIG. 4 is a bottom isometric view of an initial phase of a bit body solids modeling method constructed in accordance with the invention.
Figure 5:
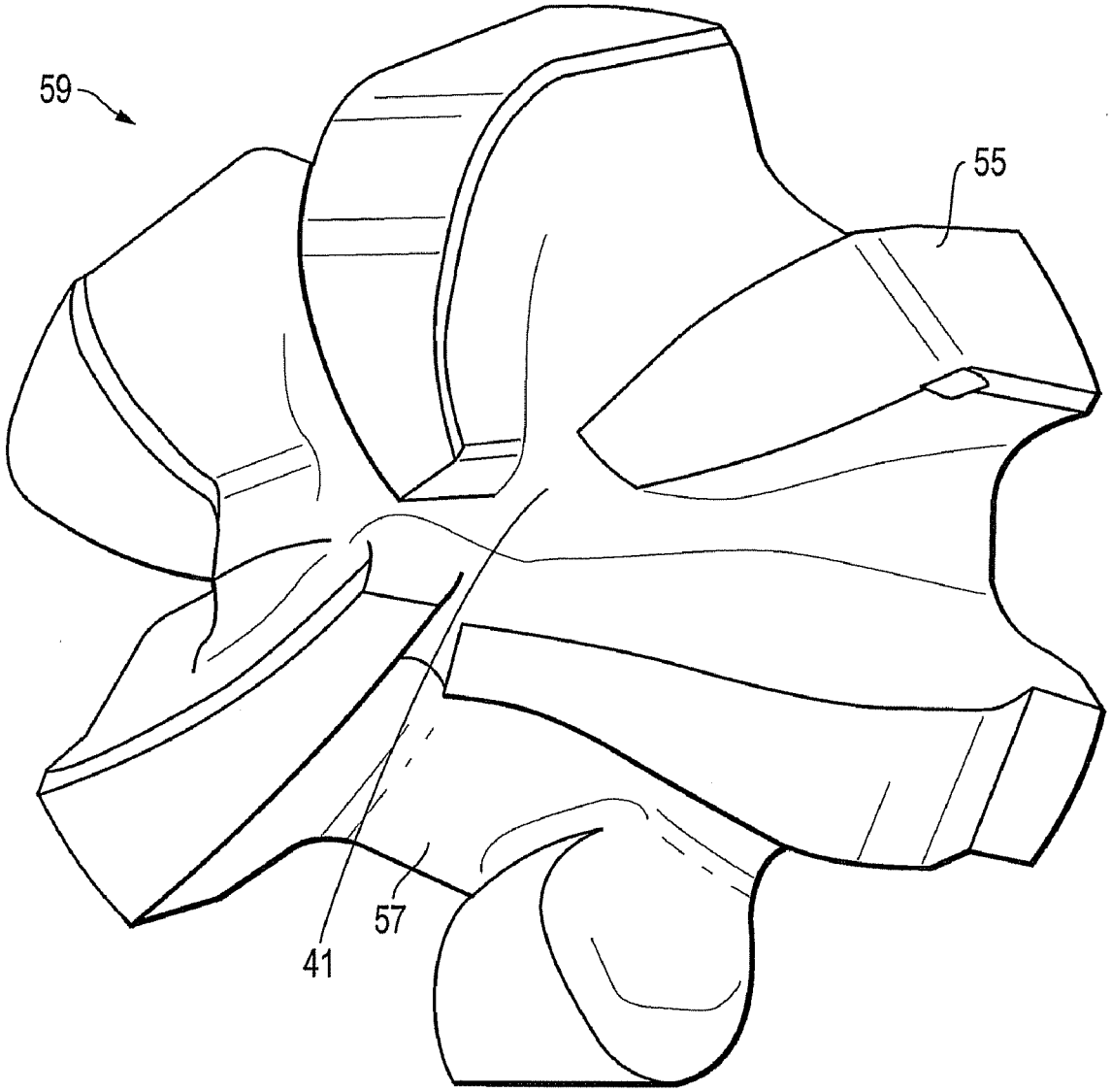
FIG. 5 is a bottom isometric view of an advanced phase of a bit body solids modeling method constructed in accordance with the invention.

The invention also comprises a method of designing junk slots in drill bits. In one embodiment, the method comprises defining a bit body solid 51 (FIG. 4), defining duct solids 53 and subtracting the duct solids from the bit body solid as shown in FIG. 4. As shown in FIG. 5, blades 55 are defined and junk slots 57 are defined between the blades 55 from a remainder of the subtraction of the previous step to form a bit body 59. Cutters (see, e.g., cutters 37 FIG. 3) are added to the blades 55 and nozzles (see, e.g., nozzles 20 in FIG. 2) are added to the junk slots 57. The junk slots 57 are then modified to optimize their shapes for adjacent cutters and nozzles and reduce balling for the drill bit. Various embodiments of the method may incorporate other features and elements as described elsewhere herein.

While the invention has been shown or described in only some of its forms, it should be apparent to those skilled in the art that it is not so limited, but is susceptible to various changes without departing from the scope of the invention.

What is claimed is:

1. A drill bit for boring earthen formations, comprising:

a bit body having an axis of rotation, a bit face transverse to the axis of rotation, and a plurality of blades extending therefrom, each blade having a plurality of cutters affixed thereto;

junk slots formed in the bit body and located between adjacent ones of the blades to define a plurality of junk slots, and a pinch point located in each junk slot on the face at a distance from the axis of rotation where a minimum cross sectional area between adjacent ones of the blades occurs; wherein at least one of the junk slots is a deep junk slot having a profile depth at its pinch point that is greater than the depths of other ones of the junk slots on the drill bit.

2. A drill bit according to claim 1, wherein said at least one of the junk slots comprises a plurality of deep junk slots.

3. A drill bit according to claim 1, wherein the cross sectional area between adjacent ones of the blades of at least one of the junk slots at the pinch point is greater than tbe cross sectional area between adjacent ones of the blades located at pinch points for said other ones of the junk slots.

4. A drill bit according to claim 1, wherein the profile depth of each of the junk slots at their respective pinch points differs from all other ones of the junk slots.

5. A drill bit according to claim 1, wherein the profile depth of each of the junk slots are substantially the same at a central area of the face inward from the pinch points.

6. A drill bit according to claim 1, wherein the bit body has hydraulic fluid nozzles located in counterbores, and areas of the bit body located between the counterbores are blended.

7. A drill bit for boring earthen formations, comprising:

a bit body having an axis of rotation, a bit face transverse to the axis of rotation, and a plurality of blades extending therefrom, each blade having a plurality of cutters affixed thereto;

junk slots formed in the bit body and located between adjacent ones of the blades to define a plurality of junk slots; and a pinch point located in each junk slot on the face at a distance from the axis of rotation where a minimum cross sectional area between adjacent ones of the blades occurs; wherein a plurality of the junk slots are defined as a primary junk slots having a primary junk slot profile depth at a pinch point that is greater than the profile depths of other ones of the junk slots at pinch points for said other ones of the junk slots.

8. A drill bit according to claim 7, wherein the cross sectional area of the primary junk slots at their respective pinch points is greater than the cross-sectional areas of the other junk slots located at pinch points for said other ones of the junk slots.

9. A drill bit according to claim 7, wherein a circumferential spacing between adjacent ones of the blades varies and the profile depth of a junk slot at its respective pinch point is larger when the circumferential spacing between such junk slot's adjacent blades is smaller, and the profile depth of a junk slot at its respective pinch point is smaller when the circumferential spacing between such junk slot's adjacent blades is larger.

10. A drill bit according to claim 7, wherein the depths of each of the junk slots are substantially the same at a central area of the face inward from the pinch points and wherein the bit body has hydraulic fluid nozzles located in counterbores, and areas of the bit body located between the counterbores are blended.

11. A method of designing junk slots in a drill bit, comprising:

(a) defining a bit body solid with an axis of rotation and a bit face transverse to the axis of rotation;

(b) defining duct solids and subtracting the duct solids from the bit body solid;

(c) defining blades and junk slots between the blades from a remainder of the subtraction of step (b) to form a bit body;

(d) defining a pinch point located in each junk slot on the face at a distance from the axis of rotation where a minimum cross sectional area between adjacent ones of the blades occurs;

(e) defining at least one of the junk slots to have a cross sectional area at its pinch point that is greater than the cross sectional area of other ones of the junk slots on the drill bit at their respective pinch points, and each of the junk slots having a radial depth extending in a radial direction with respect to the axis of rotation, and at least one of the junk slots has a radial depth that is greater than the radial depths of other ones of the junk slots; and (f) adding cutters to the blades and nozzles to the junk slots.

12. A method according to claim 11, wherein a profile-depth of each of the junk slots at each of their respective pinch points is formed at a depth that differs from all other ones of the junk slots.

13. A method according to claim 11, wherein a circumferential spacing between adjacent ones of the blades varies and a profile depth of a junk slot at its respective pinch point is larger when the circumferential spacing between such junk slot's adjacent blades is smaller, and the profile depth of a junk slot at its respective pinch point is smaller when the circumferential spacing between such junk slot's adjacent blades is larger.

14. A method according to claim 11, wherein the nozzles are located in counterbores in the bit body, and areas of the bit body located between the counterbores are blended.

15. A method according to claim 11, wherein at least one of the junk slots is defined as a primary junk slot having a primary junk slot profile depth at its pinch point that is greater than the profile depths of the other junk slots at their respective pinch points.

16. A method according to claim 15, wherein the at least one primary junk slot comprises a plurality of primary junk slots, each of which is formed at the primary junk slot profile depth at their respective pinch points.

17. A method according to claim 11, wherein a profile depths of the junk slots are substantially the same at a central area of the face inward from the pinch points.

* * * * *

UNITED STATES PATENT AND TRADEMARK OFFICE

CERTIFICATE OF CORRECTION

PATENT NO. : 7,694,755 B2
APPLICATION NO. : 11/872069
DATED : April 13, 2010
INVENTOR(S) : Timothy King Marvel et al.

It is certified that error appears in the above-identified patent and that said Letters Patent is hereby corrected as shown below:

Title page, INID Code (75), please change "David A. Trivas" to --David A. Trevas--

Column 4, Line 28, please change "tbe" to --the--

Signed and Sealed this

Fifteenth Day of June, 2010

David J. Kappos

David J. Kappos
*Director of the United States Patent and Trademark Office*